US007992286B2

(12) United States Patent
Liang

(10) Patent No.: US 7,992,286 B2
(45) Date of Patent: Aug. 9, 2011

(54) ASSEMBLY APPARATUS FOR ATTACHING DECORATIVE PIECES

(75) Inventor: Zhi-Dan Liang, Shenzhen (CN)

(73) Assignees: Shenzen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 293 days.

(21) Appl. No.: 12/348,641

(22) Filed: Jan. 5, 2009

(65) Prior Publication Data

US 2009/0307897 A1 Dec. 17, 2009

(30) Foreign Application Priority Data

Jun. 12, 2008 (CN) ..... 2008 1 0302112

(51) Int. Cl.
*B23P 19/00* (2006.01)
*H05K 13/04* (2006.01)

(52) U.S. Cl. ..... 29/729; 29/700; 29/739; 29/592.1; 118/500

(58) Field of Classification Search ..... 029/729, 029/739, 740–743; 101/121–126, 41; 116/306; 118/500, 504
See application file for complete search history.

(56) References Cited

U.S. PATENT DOCUMENTS

| | | | | |
|---|---|---|---|---|
| 6,517,376 | B1 * | 2/2003 | Hwang | 439/489 |
| 7,171,896 | B2 * | 2/2007 | Steffen et al. | 101/126 |
| 7,849,792 | B2 * | 12/2010 | Bauer et al. | 101/44 |
| 2009/0255455 | A1 * | 10/2009 | Shi et al. | 116/306 |
| 2009/0307897 | A1 * | 12/2009 | Liang | 29/700 |

* cited by examiner

*Primary Examiner* — Minh Trinh
(74) *Attorney, Agent, or Firm* — D. Austin Bonderer

(57) ABSTRACT

A assembly apparatus for attaching decorative pieces to electronic devices includes a seat, a first cover, a second cover, and a transmitting member. The seat includes a disengaging portion and an attaching portion. The disengaging portion has a recess, a protrusion and at least one positioning column in the recess. The attaching portion defines a receiving room for receiving a shell. The first cover is detachable mounted on the disengaging portion and defines at least one first through hole. The second cover is detachable mounted on the attaching portion and defines a second through hole. The transmitting member includes a latching portion. The latching portion is inserted in the first through hole to attract a decorative piece, and is inserted in the second through hole to release the decorative piece on the shell.

17 Claims, 6 Drawing Sheets

ASSEMBLY APPARATUS FOR ATTACHING DECORATIVE PIECES

BACKGROUND

1. Technical Field

The present disclosure relates to an assembly apparatus for attaching decorative pieces to electronic devices.

2. Description of Related Art

Decorative pieces are widely applied to electronic devices for improving appearance of the electronic devices. For example, decorative pieces for forming a logo generally need to be attached to a shell of an electronic device. However, in assembly, the decorative pieces are difficult to be correctly positioned on the electronic devices manually.

Therefore, an assembly apparatus for attaching decorative pieces to electronic devices is desired in order to overcome the above-described problem.

BRIEF DESCRIPTION OF THE DRAWINGS

Many aspects of an assembly apparatus for attaching decorative piece to electronic devices can be better understood with reference to the following drawings. The components in the drawings are not necessarily drawn to scale, the emphasis instead being placed upon clearly illustrating the principles of the present assembly apparatus, in which.

DETAILED DESCRIPTION OF THE EMBODIMENTS

Figure 6:
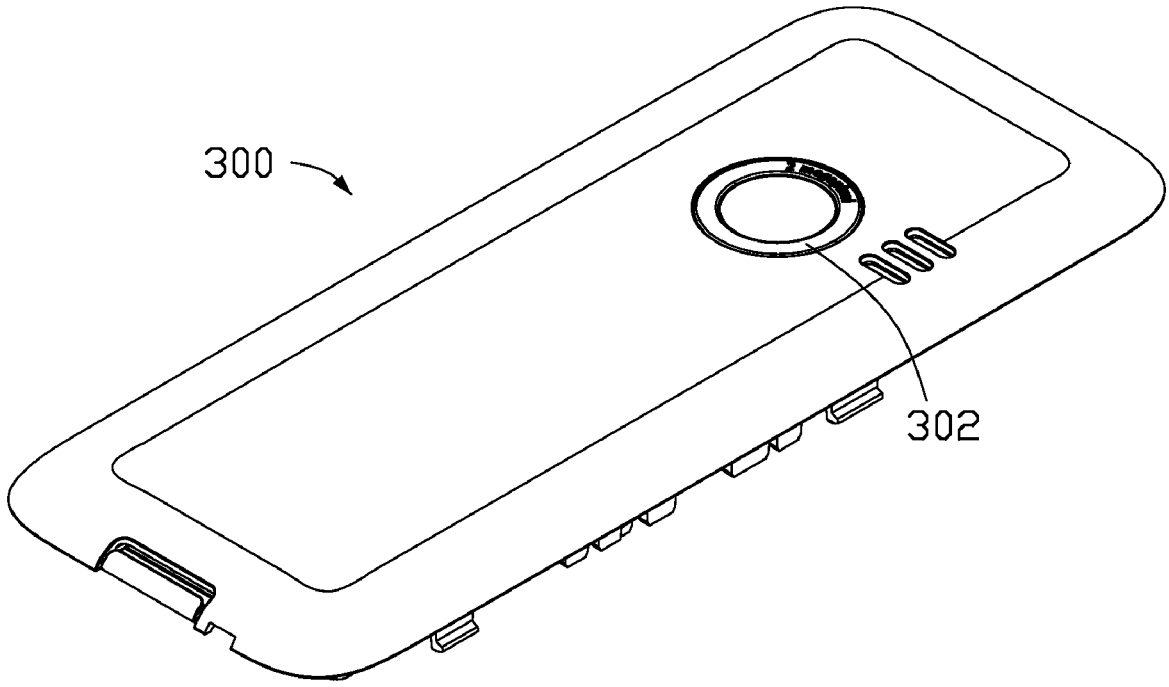
FIG. 6 is an isometric view of the shell shown in FIG. 4, with a decorative piece mounted on the shell.

The present assembly apparatus is suitable for attaching decorative pieces to electronic devices. In the embodiment illustrated hereinafter, an annular decorative piece 302 on a shell 300 of electronic devices shown in FIG. 6 is given as an example to illustrate the present assembly apparatus. It is to be understood, however, that the present assembly apparatus could be advantageously used in other environments. As such, the present assembly apparatus should not be limited in scope by the examples given herein.

Figure 1:
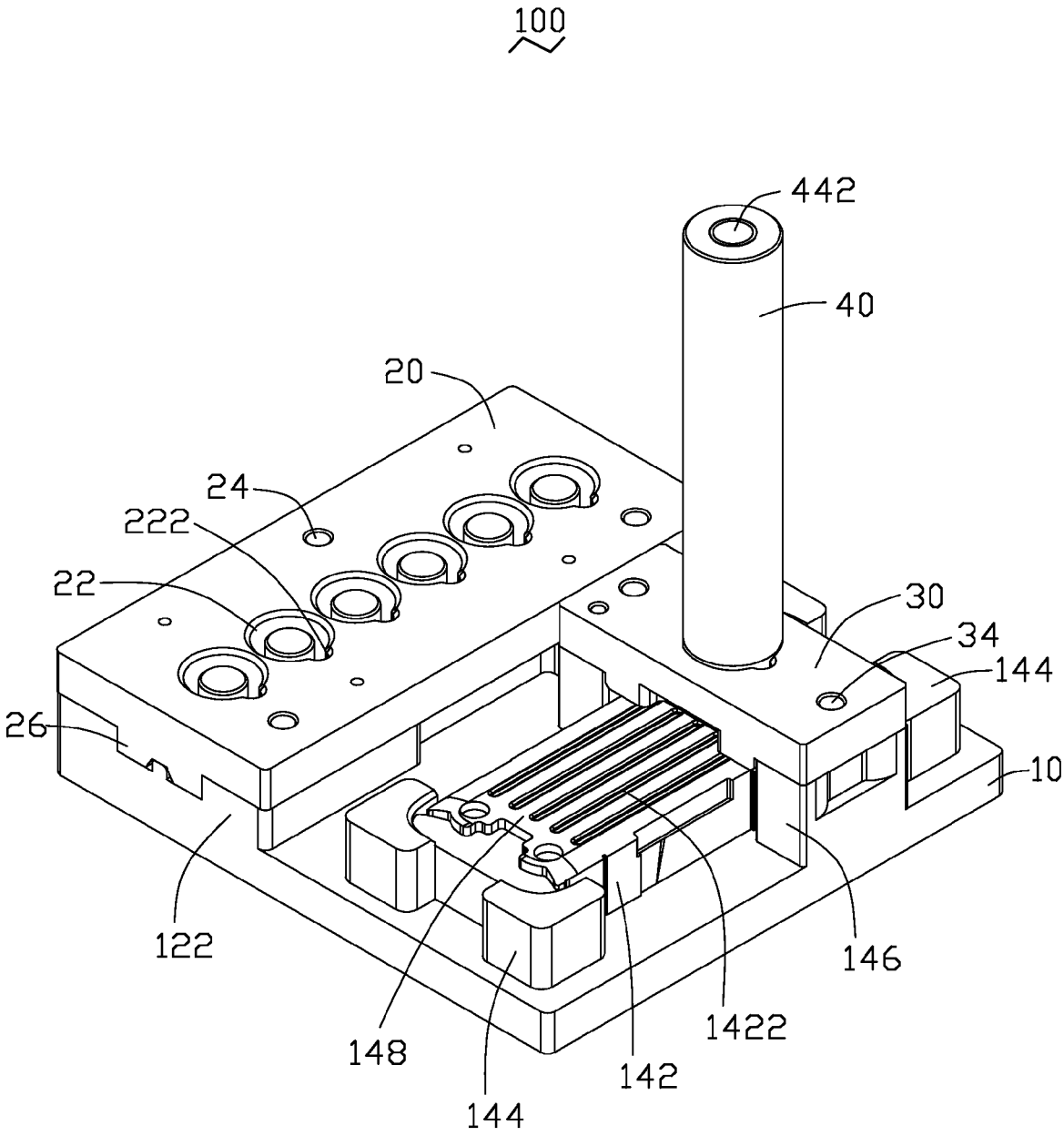
FIG. 1 is an assembled, isometric view of an assembly apparatus for attaching a decorative piece to an electronic device, in accordance with an exemplary embodiment.

FIG. 1 shows an assembled, isometric view of a assembly apparatus 100, in accordance with an exemplary embodiment. The assembly apparatus 100 includes a seat 10, a first cover 20, a second cover 30, and a transmitting member 40. The first cover 20 and the second cover 30 are respectively mounted on the seat 10. The transmitting member 40 is attached to the second cover 30.

Figure 2:
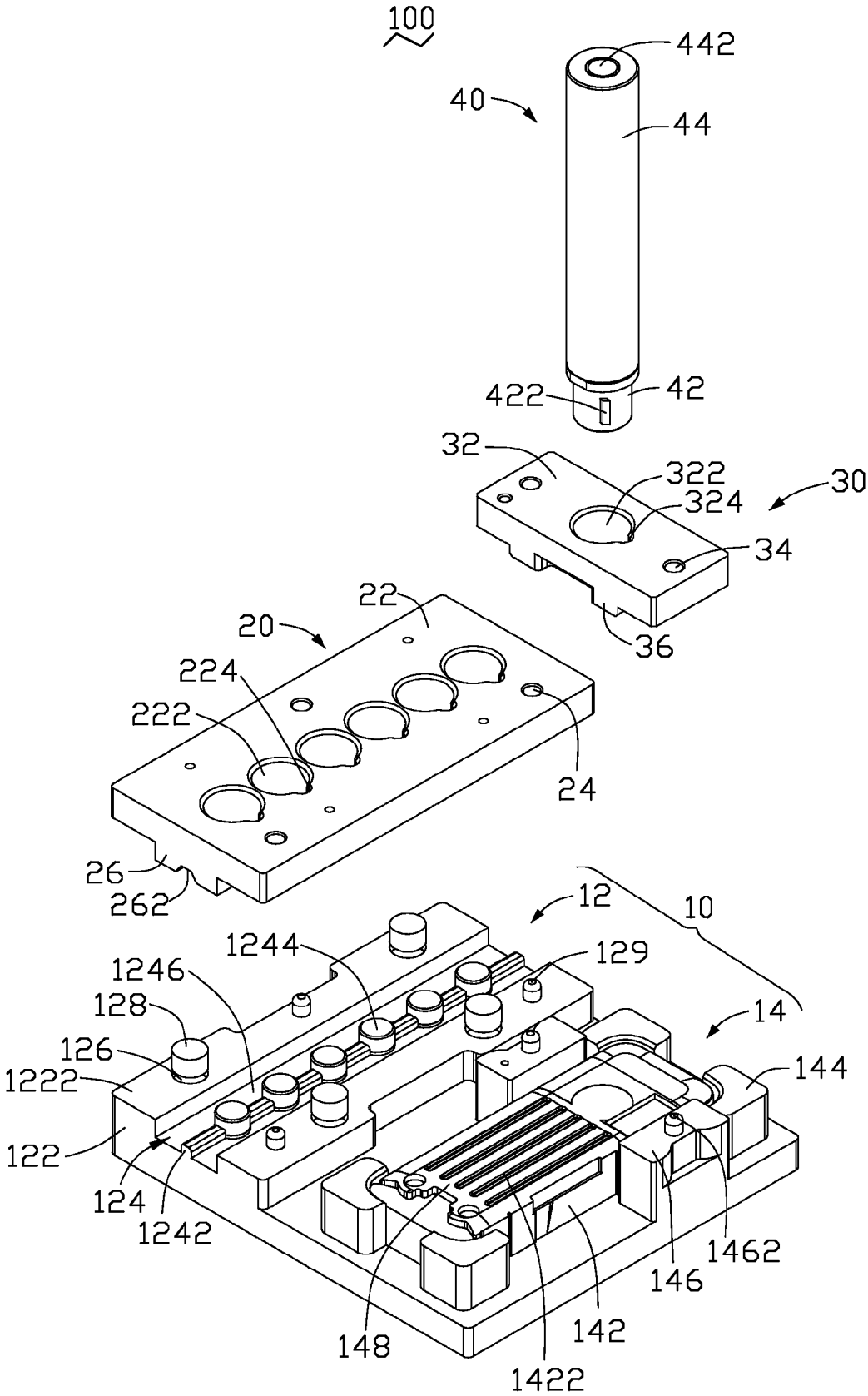
FIG. 2 is an exploded, isometric view of the assembly apparatus shown in FIG. 1.

Referring to FIG. 2, the seat 10 includes a disengaging portion 12 and an attaching portion 14. The disengaging portion 12 is configured for fixing a flexible piece 200 with the decorative pieces 302 thereon (shown in FIG. 4), and includes a generally cuboid main body 122. The main body 122 has a top surface 1222, and a rectangular recess 124 defined in the top surface 1222. The recess 124 extends through the main body 122, and has a bottom surface 1246. A protrusion 1242 and a plurality of spaced positioning columns 1244 are formed on the bottom surface 1246 of the recess 124. The protrusion 1242 connects the positioning columns 1244 in a line. The positioning columns 1244 are configured for positioning the decorative pieces 302. The main body 122 defines a plurality of receiving holes 126 in the top surface 1222 thereof. Each of the receiving holes 126 is used for receiving a magnetic column 128. A plurality of first positioning pins 129 are positioned on the top surface 1222 of the main body 122.

The attaching portion 14 is configured for receiving a shell 300 (shown in FIG. 4), and includes a base 142, four blocks 144, and two supporting arms 146. The base 142 has an upper surface 1422 configured for matching the shape of the shell 300. The blocks 144 are higher than the upper surface 1422 of the base 142, and are respectively positioned around four corners of the base 142. The upper surface 1422 of the base 142 and the four blocks 144 cooperatively form a receiving room 148 for receiving the shell 300. The two supporting arms 146 are positioned at two sides of the base 142, and are higher than the upper surface 1422. Two second positioning pins 1462 are respectively formed on the supporting arms 146.

Figure 3:
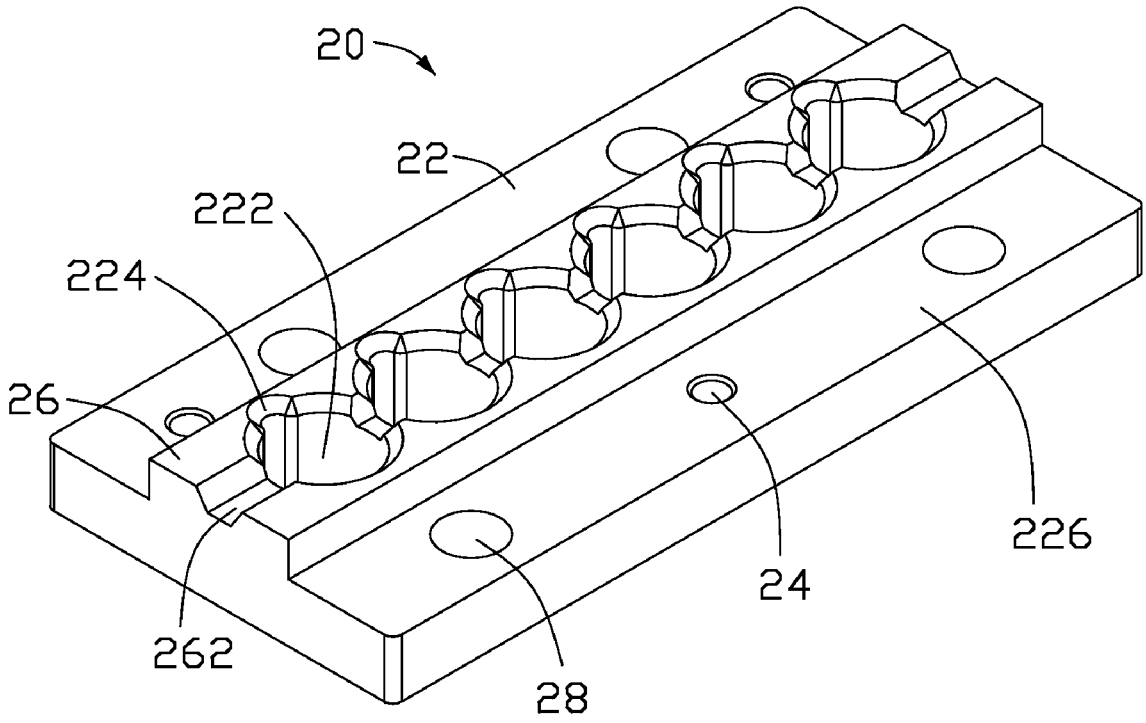
FIG. 3 is an inverted isometric view of a first cover shown in FIG. 1.

Referring to FIG. 3, the first cover 20 includes a rectangular flat board 22 and a protruding portion 26. The flat board 22 has a lower surface 226. The protruding portion 26 is formed on the lower surface 226, extending to two ends of the flat board 22. The flat board 22 defines a plurality of first through holes 222 traversing the flat board 22 and the protruding portion 26. A corresponding number of first latching notches 224 are respectively defined to communicate the first through holes 222, for latching the transmitting member 40. The protruding portion 26 defines a groove 262 communicating with the first through holes 222. The groove 262 is configured for receiving the protrusion 1242 of the disengaging portion 12. A plurality of first positioning holes 24 and blind holes 28 are positioned at two sides of the protruding portion 26. The positions of the first positioning holes 24 and the blind holes 28 respectively correspond to the first positioning pins 129 and the magnetic columns 128. Each first positioning hole 24 receives a corresponding first positioning pin 129, and each blind hole 28 receives a corresponding magnetic column 128. A magnetic member (not shown) is set on a bottom surface (not shown) in the blind hole 28 for attracting the magnetic column 128. Thus, the first cover 20 can be firmly attached to the disengaging portion 12 of the seat 10 by engagement of the magnetic columns 128 and the blind holes 28.

Referring back to FIG. 2, the second cover 30 includes a plank 32 and two pressing portions 36 extending from a surface of the plank 32. The plank 32 defines a second through hole 322 and two second positioning holes 34. The shape of the second through hole 322 is similar to that of the first through hole 222. A corresponding number of second latching notches 324 are defined to respectively communicate with the second through holes 322, for latching the transmitting member 40. The second positioning holes 34 are configured for receiving a corresponding second positioning pin 1462. The two pressing portions 36 are positioned at two sides of the second through hole 322 and configured for resisting the shell 300.

The transmitting member 40 includes a feeding portion 44 and a latching portion 42 extending from one end of the feeding portion 44. Both the feeding portion 44 and the latching portion 42 are cylindrical. The diameter of the latching portion 42 is smaller than that of the feeding portion 44. A projection 422 is formed on a circular surface of the latching portion 42, configured for engaging in the first latching notches 224 and the second latching notches 324. An air hole 442 is defined along an axial direction in the transmitting member 40. The air hole 442 extends through the feeding portion 44 and the latching portion 42.

Figure 4:
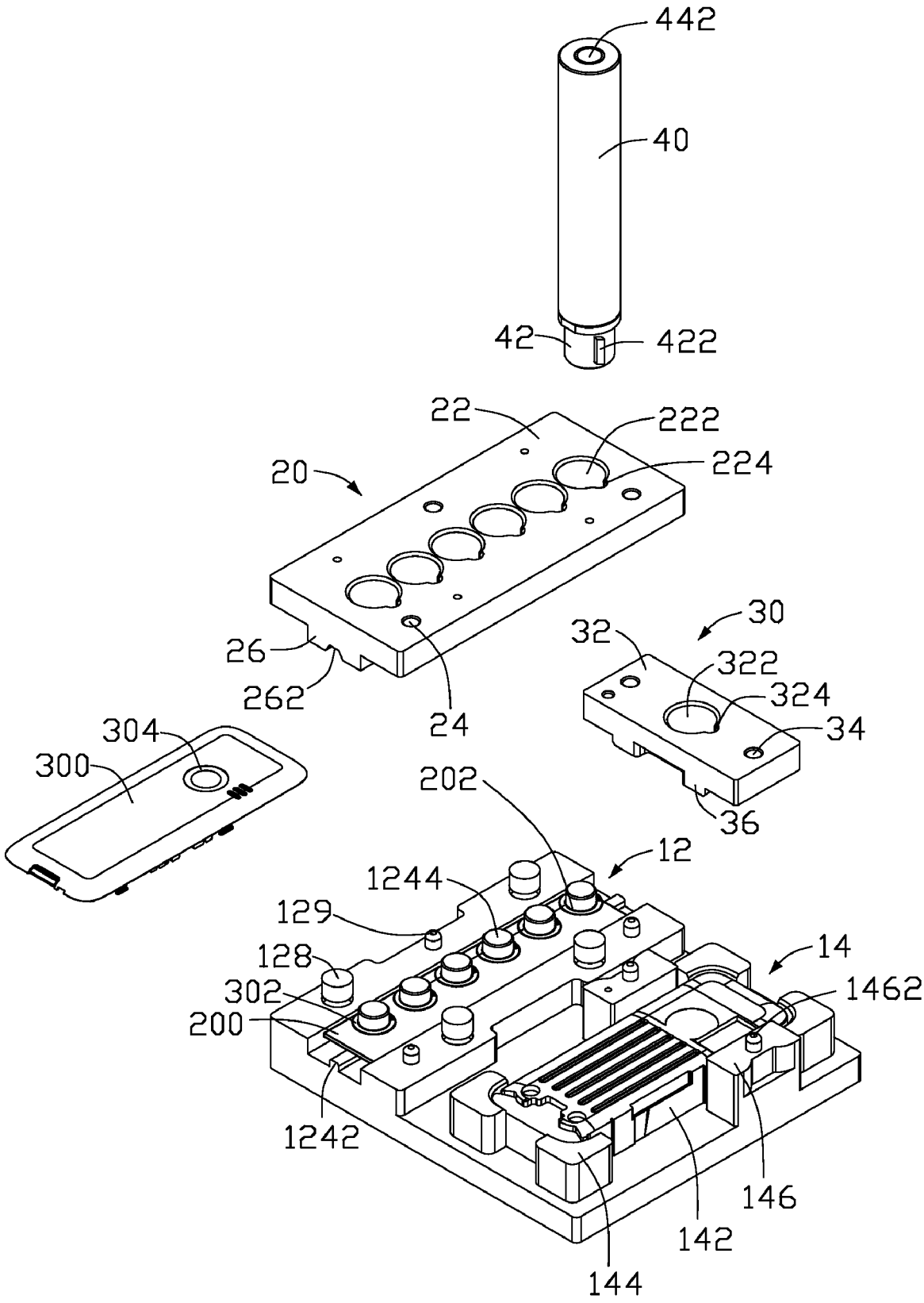
FIG. 4 is an exploded, isometric view of the assembly apparatus shown in FIG. 1, with a shell of an electronic device and decorative pieces on a flexible piece.

FIG. 4 shows the assembly apparatus 100, incorporating the shell 300 and the decorative pieces 302 on the flexible piece 200. The shell 300 defines an annular groove 304 for receiving the decorative piece 302. The shape of each decorative piece 302 is similar to that of the annular groove 304. Each decorative piece 302 has a contact surface (not shown) with a light coat of adhesive applied thereon for contacting the flexible piece 200. The surface of the flexible piece 200 is smooth, so that the decorative pieces 302 can be easily separated from the flexible piece 200 with the adhesive intact for fixing to the shell 300. The flexible piece 200 defines a plurality of through holes 202 corresponding to the positioning columns 1244. The decorative pieces 302 are respectively set around the through holes 202. The flexible piece 200 with the decorative pieces 302 is received in the recess 124, with the positioning columns 1244 respectively extending out from the through holes 202.

Figure 5:
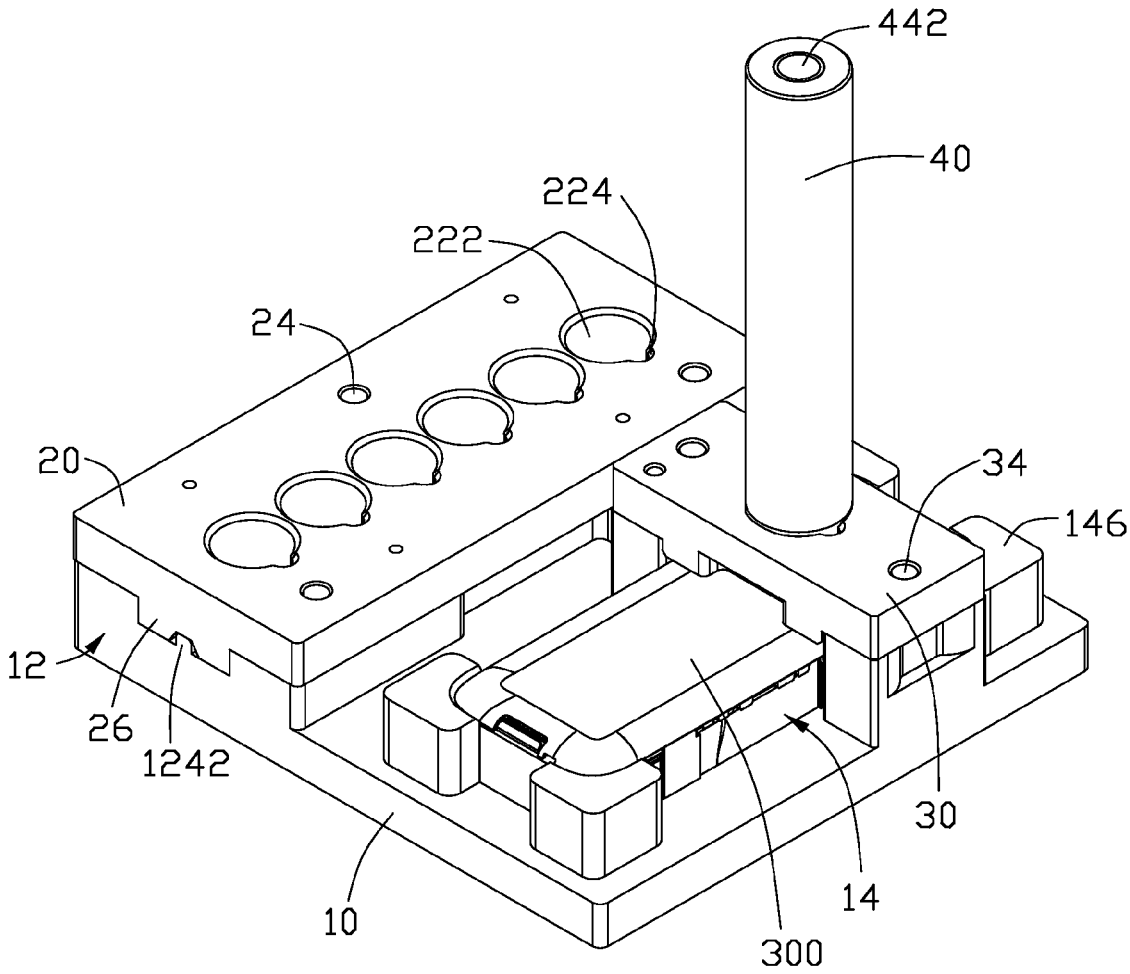
FIG. 5 is showing the assembly apparatus of FIG. 4 assembled and the shell mounted on the assembly apparatus.

Referring to FIG. 5, the flexible piece 200 with the decorative pieces 302 is received in the recess 124 (referring to FIG. 4), and the shell 300 is mounted on the attaching portion 14. The first cover 20 is assembled to the disengaging portion 12. The first positioning pins 129 are engaged in the corresponding first positioning holes 24. The groove 262 and the first through holes 222 of the first cover 20 respectively correspond to the protrusion 1242 and the positioning columns 1244 of the disengaging portion 12. The magnetic columns 128 respectively engage in the blind holes 28, with an attracting force produced between the magnetic columns 128 and the magnetic members in the blind holes 28. Two sides of the flexible piece 200 are pressed down along the protrusion 1242 by the protruding portion 26, and the decorative pieces 302 are disengaged from the flexible piece 200.

The second cover 30 is assembled to the attaching portion 14. The second positioning pins 1462 are respectively engaged in the second positioning holes 34. The two pressing portions 36 resist the shell 300, with the second through hole 322 aligned with the annular groove 304 of the shell 300.

The transmitting member 40 is inserted into one of the first through holes 222, and is positioned by engagement of the projection 422 and the first latching notch 224. The latching portion 42 contacts the decorative piece 302. Air is sucked up from the air hole 442, and the decorative piece 302 is absorbed and firmly attached to the latching portion 42. The transmitting member 40 with the decorative piece 302 is moved and inserted into the second through hole 322. The transmitting member 40 and the decorative piece 302 are positioned by engagement of the projection 422 and the second latching notch 324. The air hole 442 is filled with air, and the attracting force between the transmitting member 40 and the decorative piece 302 is released. The decorative piece 302 is pushed into the annular groove 304 of the shell 300 by the transmitting member 40, and is firmly attached to the shell 300 by the adhesive. The transmitting member 40 is moved out from the second through hole 322. The second cover 30 is disengaged from the attaching portion 14. The shell 300 with the decorative piece 302 fixed in the annular groove 304 (shown in FIG. 6) is moved away from the attaching portion 14. Another shell 300 without a decorative piece 302 thereon is then fixed in the attaching portion 14, and the transmitting member 40 repeats the above actions.

It is to be further understood that the magnetic columns 128 of the disengaging portion 12 and the corresponding blind holes 28 of the first cover 20 may be omitted, and the first cover 20 is pressed down by the flexible piece 200.

It is to be further understood that the positioning blocks 144 of the attaching potion may be joined together or separate, and the number of the positioning blocks 144 may be decided according to need.

It is to be understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An assembly apparatus for attaching decorative pieces to electronic devices, comprising:

a seat including a disengaging portion and an attaching portion, the disengaging portion having a recess, a protrusion and at least one positioning column being formed on a bottom surface of the recess, the protrusion connecting the positioning column, the attaching portion defining a receiving room for receiving a shell of electronic device;

a first cover being detachably mounted on the disengaging portion of the seat and defining at least one first through hole, the first through hole corresponding to the at least one positioning column, the first cover having a protruding portion being received in the recess of the disengaging portion, the protruding portion defining a groove for receiving the protrusion of the disengaging portion, the groove communicating to the first through hole;

a second cover being detachably mounted on the attaching portion and defining a second through hole; and a transmitting member including a latching portion, the latching portion being capable of being inserted in the first through hole to attract a decorative piece, and inserted in the second through hole to release and attach the decorative piece on the shell.

2. The assembly apparatus as claimed in claim 1, wherein the transmitting member defines an air hole along an axial direction thereof, and the transmitting member attracts the decorative piece by sucking up air from the air hole, and releases the decorative piece by filling in air in the air hole.

3. The assembly apparatus as claimed in claim 1, wherein the first cover comprises a plurality of first positioning holes, and the disengaging portion further comprises a plurality of first positioning pins for respectively engaging in the first positioning holes.

4. The assembly apparatus as claimed in claim 1, wherein the second cover comprises a plurality of second positioning holes, and the attaching portion further comprises a plurality of second positioning pins for respectively engaging in the second positioning holes.

5. The assembly apparatus as claimed in claim 1, wherein the disengaging portion further comprises a plurality of magnetic columns fixed thereon, and the first cover defines a plurality of receiving holes for respectively receiving the magnetic columns.

6. The assembly apparatus as claimed in claim 5, wherein a plurality of magnetic members are respectively fixed in the plurality of receiving holes, the magnetic members are configured for attracting the magnetic columns.

7. The assembly apparatus as claimed in claim 1, wherein a first latching notch is defined in each of the at least one first through hole and communicating therewith, a second latching notch is defined in the second cover to communicate the second through hole, a projection is formed on the latching portion of the transmitting member, and the projection is configured for matching the first and second latching notches.

8. The assembly apparatus as claimed in claim 1, wherein the number of the at least one positioning column and the at least one first through hole is at least two.

9. The assembly apparatus as claimed in claim 1, wherein the attaching portion comprising a base, at least one block around the base, the base has an upper surface configured for matching the shape of the shell, the block is higher than the upper surface of the base, and the block and the upper surface define the receiving room.

10. The assembly apparatus as claimed in claim 9, wherein the number of the at least one block is four, and the four blocks are respectively around four corner of the base.

11. The assembly apparatus as claimed in claim 10, wherein the attaching portion further comprises two supporting arms positioned at two sides of the base to support the shell, the supporting arms are higher than the upper surface of the base, two second positioning pins are respectively formed on the supporting arms, and the second cover defines two second positioning holes corresponding to the second positioning pins.

12. The assembly apparatus as claimed in claim 1, wherein the transmitting member further comprises a feeding portion, and the latching portion is formed at one end of the feeding portion.

13. The assembly apparatus as claimed in claim 1, wherein the second cover further comprises two pressing portions for resisting the shell.

14. The assembly apparatus as claimed in claim 1, wherein the protrusion and the positioning column are positioned in line.

15. An assembly apparatus for attaching decorative pieces to electronic devices, comprising:

a seat including a disengaging portion and an attaching portion, the disengaging portion having a recess, a positioning column being formed on a bottom surface of the recess, the attaching portion defining a receiving room for receiving a shell of the electronic devices;

a first cover being detachably mounted on the disengaging portion of the seat and defining at least one first through hole, the first through hole corresponding to the positioning column, the first cover having a protruding portion being received in the recess of the disengaging portion;

a second cover being detachably mounted on the attaching portion and defining a second through hole; and a transmitting member defining an air hole, the transmitting member being capable of attracting a decorative piece in the first through hole when the air in the air hole is sucked up, and the transmitting member being capable of releasing the decorative piece on the shell in the second through hole when the air hole is filled with air.

16. The assembly apparatus as claimed in claim 15, wherein the disengaging portion comprises a plurality of magnetic columns fixed thereon, the first cover defines a plurality of receiving holes, each of the receiving holes received a magnetic member for attracting one of the magnetic columns.

17. The assembly apparatus as claimed in claim 16, wherein the first cover defines a plurality of first latching notches communicating to the first through holes cooperatively, the second cover defines a plurality of first latching notches communicating to the second through holes cooperatively, and a projection is formed on the latching portion of the transmitting member to engage with the first and second latching notches.

* * * * *